US008430174B2

(12) United States Patent
Holderman et al.

(10) Patent No.: US 8,430,174 B2
(45) Date of Patent: Apr. 30, 2013

(54) ANHYDROUS BORON-BASED TIMED DELAY PLUGS

(75) Inventors: Luke W. Holderman, Plano, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 349 days.

(21) Appl. No.: 12/879,665

(22) Filed: Sep. 10, 2010

(65) Prior Publication Data

US 2012/0061102 A1 Mar. 15, 2012

(51) Int. Cl.
*E21B 29/00* (2006.01)

(52) U.S. Cl.
USPC ..... 166/376; 166/317; 166/227

(58) Field of Classification Search ..... 166/376, 166/317, 227
See application file for complete search history.

(56) References Cited

U.S. PATENT DOCUMENTS

| | | | | |
|---|---|---|---|---|
| 4,634,314 | A | 1/1987 | Pierce | |
| 5,479,986 | A | 1/1996 | Gano et al. | |
| 5,685,372 | A | 11/1997 | Gano | |
| 5,765,641 | A | 6/1998 | Shy et al. | |
| 6,006,671 | A | 12/1999 | Yunan | |
| 6,026,903 | A | 2/2000 | Shy et al. | |
| 6,220,350 | B1 * | 4/2001 | Brothers et al. | 166/192 |
| 6,706,348 | B2 | 3/2004 | Quigley et al. | |
| 6,857,452 | B2 | 2/2005 | Quigley et al. | |
| 6,896,058 | B2 | 5/2005 | Munoz, Jr. et al. | |
| 7,000,680 | B2 | 2/2006 | Kurokawa et al. | |
| 7,093,664 | B2 | 8/2006 | Todd et al. | |
| 7,121,342 | B2 | 10/2006 | Vinegar et al. | |
| 7,353,879 | B2 | 4/2008 | Todd et al. | |
| 7,510,000 | B2 | 3/2009 | Pastor-Sanz et al. | |
| 7,546,873 | B2 | 6/2009 | Kim et al. | |
| 7,661,481 | B2 | 2/2010 | Todd et al. | |
| 7,699,101 | B2 | 4/2010 | Fripp et al. | |
| 7,789,152 | B2 | 9/2010 | Langeslag | |
| 2004/0231845 | A1 | 11/2004 | Cooke, Jr. | |
| 2005/0274524 | A1 | 12/2005 | Silguero | |
| 2006/0219407 | A1 | 10/2006 | Livingstone | |
| 2006/0275563 | A1 | 12/2006 | Duffy | |

(Continued)

FOREIGN PATENT DOCUMENTS

| | | |
|---|---|---|
| EP | 0009315 A1 | 4/1980 |
| GB | 2432377 A | 5/2007 |

OTHER PUBLICATIONS

Office Action issued Jul. 20, 2012 for U.S. Appl. No. 12/758,781, 32 pages.

(Continued)

*Primary Examiner* — Giovanna Wright
(74) *Attorney, Agent, or Firm* — Smith IP Services, P.C.

(57) ABSTRACT

A well tool for use with a subterranean well can include an elongated passageway and a plug which prevents fluid communication through the passageway for a predetermined period of time. The plug can including an anhydrous boron compound, whereby the predetermined period of time is determined by a length of the anhydrous boron compound. A method of operating a well tool in conjunction with a subterranean well can include exposing an anhydrous boron compound to an aqueous fluid, with the anhydrous boron compound being included in a plug which prevents fluid communication through a passageway of the well tool. The well tool can be operated in response to fluid communication being permitted through the passageway a predetermined period of time after the exposing step.

28 Claims, 3 Drawing Sheets

U.S. PATENT DOCUMENTS

| | | | | |
|---|---|---|---|---|
| 2006/0276345 | A1 | 12/2006 | Todd et al. | |
| 2007/0074873 | A1 | 4/2007 | McKeachnie et al. | |
| 2007/0221387 | A1 | 9/2007 | Levy | |
| 2007/0277979 | A1 | 12/2007 | Todd et al. | |
| 2008/0066923 | A1 | 3/2008 | Xu | |
| 2008/0066924 | A1 | 3/2008 | Xu | |
| 2008/0084106 | A1 | 4/2008 | Marathe et al. | |
| 2008/0135249 | A1 | 6/2008 | Fripp et al. | |
| 2008/0149351 | A1 | 6/2008 | Marya et al. | |
| 2008/0305326 | A1 | 12/2008 | Gavel et al. | |
| 2009/0084539 | A1 | 4/2009 | Duan et al. | |
| 2009/0283271 | A1* | 11/2009 | Langeslag | 166/297 |
| 2010/0089565 | A1 | 4/2010 | Duan et al. | |
| 2010/0200235 | A1 | 8/2010 | Luo et al. | |
| 2010/0243269 | A1 | 9/2010 | Solhaug et al. | |
| 2011/0088901 | A1 | 4/2011 | Watters et al. | |
| 2011/0247833 | A1 | 10/2011 | Todd et al. | |
| 2012/0061102 | A1 | 3/2012 | Holderman et al. | |
| 2012/0160478 | A1 | 6/2012 | Todd et al. | |

OTHER PUBLICATIONS

Office Action issued Jul. 23, 2012 for U.S. Appl. No. 13/406,359, 27 pages.

International Search Report with Written Opinion issued Jun. 26, 2012 for PCT Patent Application No. PCT/US11/060787, 9 pages.

A.C. Albertsson, "Advances in Polymer Science" vol. 157 entitled "Degradable Aliphatic Polyesters," Springer-Verlag Berlin Heidelberg publication, dated 2002.

International Search Report with Written Opinion issued Dec. 12, 2011 for PCT Patent Application No. PCT/US11/031242, 11 pages.

Office Action issued Nov. 23, 2012 for U.S. Appl. No. 12/758,781, 20 pages.

Advisory Action issued Jan. 16, 2013 for U.S. Appl. No. 13/406,359, 3 pages.

Halliburton, Luke Holderman; Activiation Screen, Defensive Publication; Dec. 14, 2009; 3 pages.

Borax; Dehybor®, Anhydrous Borax Product Profile; Undated; 3 pages.

U.S. Appl. No. 12/554,035, filed Sep. 4, 2009; 36 pages.

Halliburton, Completion Tools; Mirage® Disappearing Plug and Autofill Sub; Product Brochure H00093; Aug. 2005; 2 pages.

Halliburton, Easywell; Reliable Zonal Isolation; H05794; dated Sep. 2009; 6 pages.

Halliburton, Easywell; Swellpacker® Lite II Isolation System; H06917; Dec. 2009; 2 pages.

Office Action issued Nov. 6, 2012 for U.S. Appl. No. 12/951,252, 26 pages.

Office Action issued Nov. 7, 2012 for U.S. Appl. No. 13/406,359, 25 pages.

* cited by examiner

ANHYDROUS BORON-BASED TIMED DELAY PLUGS

BACKGROUND

This disclosure relates generally to equipment utilized and operations performed in conjunction with a subterranean well and, in an example described below, more particularly provides anhydrous boron-based timed delay plugs.

It can be advantageous to be able to delay operation of a well tool. For example, it may be desirable to delay operation of a well tool until it is appropriately positioned in a well, until another well tool has been actuated, or until conditions are favorable, circumstances are convenient, etc.

However, most past attempts at delaying well tool operation have relied on delay mechanisms which are either complex, unreliable, expensive, difficult to operate, etc. Therefore, it will be appreciated that it would be beneficial to provide an improved way to delay well tool operation.

SUMMARY

In the disclosure below, an anhydrous boron-based timed delay plug is provided which brings improvements to the art of delaying well tool operation, or otherwise delaying fluid communication through a passageway. One example is described below in which a well tool is operated a certain time after an anhydrous boron compound is exposed to an aqueous fluid. Another example is described below in which a length of an anhydrous boron compound plug is used to determine a period of time after which fluid communication is permitted through a passageway.

In one aspect, a well tool for use with a subterranean well is provided by the disclosure below. The well tool can include an elongated passageway and a plug which prevents fluid communication through the passageway for a predetermined period of time. The plug includes an anhydrous boron compound. The predetermined period of time is determined by a length of the anhydrous boron compound.

In another aspect, a method of operating a well tool in conjunction with a subterranean well is provided. The method can include exposing an anhydrous boron compound to an aqueous fluid, with the anhydrous boron compound being included in a plug which prevents fluid communication through a passageway of the well tool. The well tool operates in response to fluid communication being permitted through the passageway a predetermined period of time after the exposing step.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
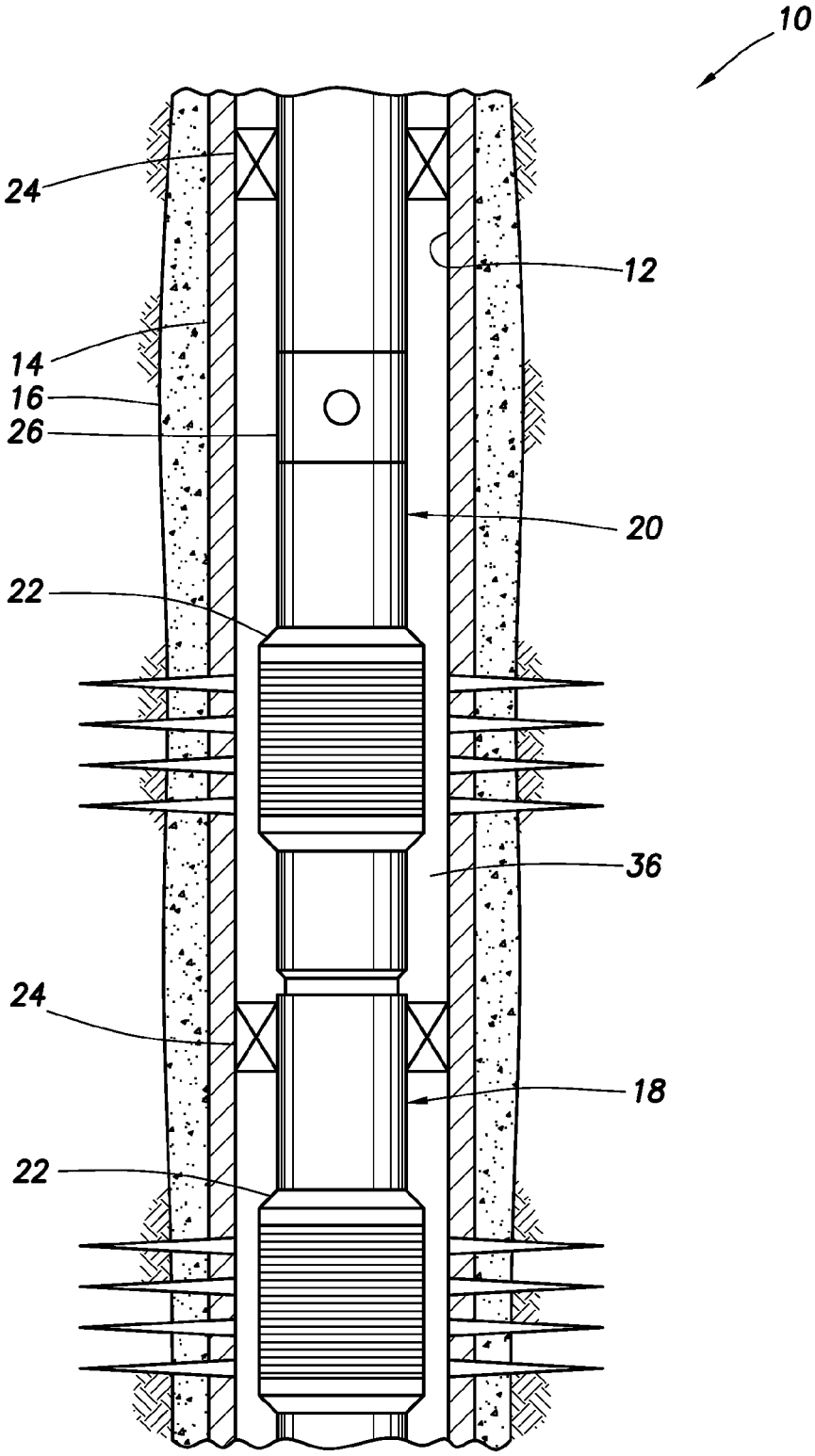
FIG. 1 is a schematic partially cross-sectional view of a well system and associated method which can embody principles of the present disclosure.

Representatively illustrated in FIG. 1 is a well system 10 and associated method which can embody principles of this disclosure. As depicted in FIG. 1, a wellbore 12 is lined with casing 14 and cement 16, the casing has been perforated, and lower and upper completion strings 18, 20 have been installed in the wellbore.

Each of the completion strings 18, 20 includes a number of well tools 22, 24, 26. These well tools 22, 24, 26 can include the illustrated well screen assemblies, packers and valves, and/or any other types of well tools (such as perforating guns, firing heads, samplers, hangers, formation testers, gravel packing tools, stimulation tools, etc.).

At this point, it should be emphasized that the well system 10 is provided as merely one example of a wide variety of different types of well systems which can benefit from use of the principles described by this disclosure. Thus, it should be clearly understood that those principles are not limited at all to any of the details of the well system 10 and associated method described herein.

It would be useful in many circumstances to be able to delay operation or actuation of a well tool until a certain period of time has elapsed. For example, when installing well screen assemblies, clogging of the well screens can be minimized by preventing flow through the well screens during installation.

Preventing flow through the well screens can also allow pressure to be applied to a completion string to set a packer, without the need for installing a plug in the completion string. After the completion string has been installed and appropriately positioned in the well, the packer can be set, and the well screens can be opened for gravel packing, production of fluids, etc.

In the well system 10, it may be desirable to prevent flow of fluid through the well tools 22 until after installation of the completion strings 18, 20, it may be desirable to prevent setting of the lower well tool 24 until after installation of the lower completion string 18, it may be desirable to prevent setting of the upper well tool 24 until after installation of the upper completion string 20, it may be desirable to close the well tool 26 after a gravel packing operation, etc. These are just a few examples of the many different reasons why it could be beneficial to be able to delay operation or actuation of a well tool, so it should be clearly understood that the principles of this disclosure are not limited in any way to only these types of operation or actuation delays.

Figure 2:
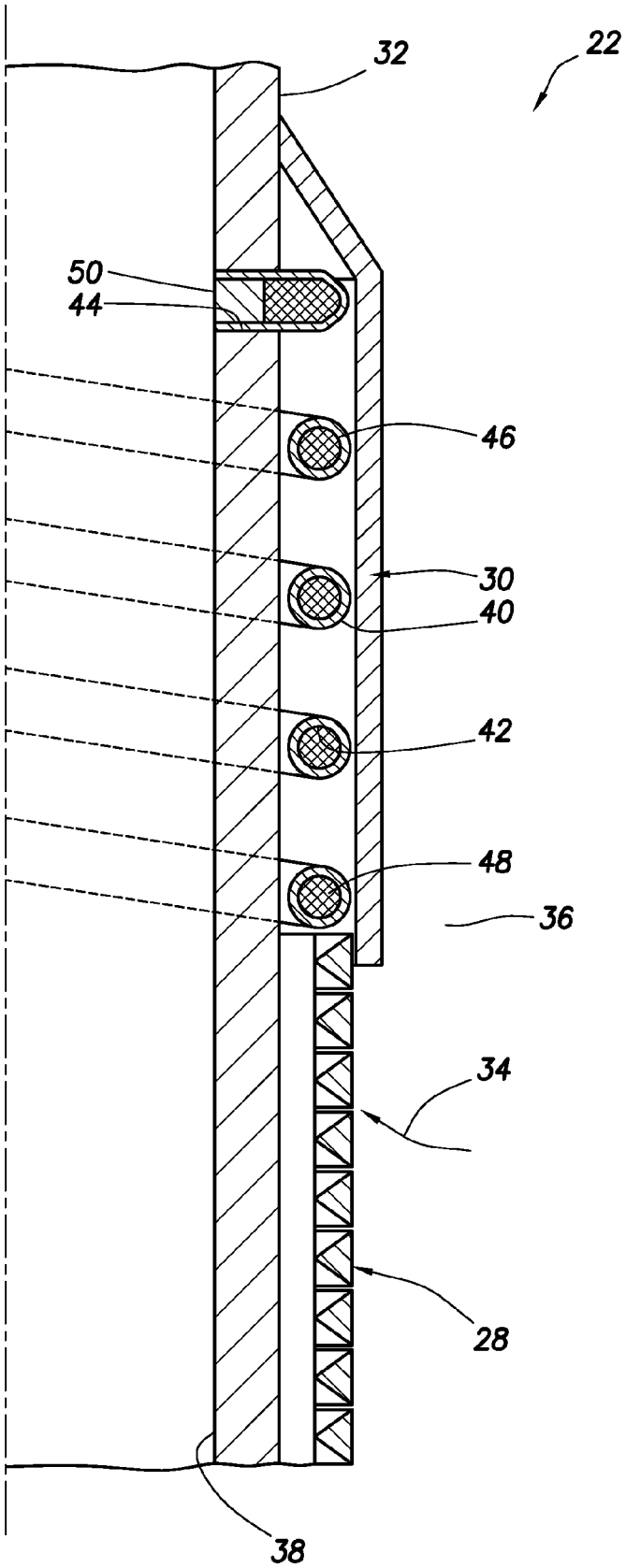
FIG. 2 is an enlarged scale schematic cross-sectional view through a well tool which may be used in the well system.

Referring additionally now to FIG. 2, an enlarged scale cross-sectional view of a portion of one of the well tools 22 is representatively illustrated. In this view, it may be seen that the well tool 22 includes a well screen 28 and a flow control device 30 disposed on a tubular member 32.

The well screen 28 is configured for filtering fluid 34 which flows from the exterior of the well screen (such as, from an annulus 36 formed radially between the wellbore 12 and the completion strings 18, 20) to an interior flow passage 38 which extends longitudinally through the tubular member 32. When the tubular member 32 is interconnected as part of one of the completion strings 18, 20, the flow passage 38 also extends through the completion string.

The flow control device 30 prevents such flow of the fluid 34 into the passage 38, and also prevents flow of fluid outward from the passage. Thus, when the well screen 28 is being installed, clogging of the well screen can be prevented (or at least reduced) and, if there is a need to apply pressure to the passage 38 (for example, to set a pressure-set packer), such pressure can be applied without the time and expense of plugging the passage.

The flow control device 30 depicted in FIG. 2 includes a tube 40 coiled about the tubular member 32. A passageway 42 extends through the tube 40. At one end of the tube 40, the passageway 42 is at the internal flow passage 38 of the tubular member 32 (with the tube extending through an opening 44 in a sidewall of the tubular member in the example of FIG. 2), and at an opposite end of the tube the passageway is at the well screen 28.

A plug 46 in the passageway 42 prevents fluid communication through the passageway. Thus, as depicted in FIG. 2, flow of the fluid 34 through the well screen 28 and into the interior of the tubular member 32 is prevented by the plug 46. In one unique feature of the flow control device 30, the plug 46 can be dissolved at a known rate, thereby providing a predetermined period of time, after which fluid communication is permitted through the passageway 42.

Preferably, the plug 46 comprises an anhydrous boron compound 48. The anhydrous boron compound 48 hydrates when exposed to an aqueous fluid. Such anhydrous boron compounds include, but are not limited to, anhydrous boric oxide and anhydrous sodium borate.

Preferably, the anhydrous boron compound 48 is initially provided as a granular material. As used herein, the term "granular" includes, but is not limited to, powdered and other fine-grained materials.

As an example, the granular material comprising the anhydrous boron compound is preferably placed in a graphite crucible, the crucible is placed in a furnace, and the material is heated to approximately 1000 degrees Celsius. The material is maintained at approximately 1000 degrees Celsius for about an hour, after which the material is allowed to slowly cool to ambient temperature with the furnace heat turned off. As a result, the material becomes a solid mass comprising the anhydrous boron compound 48.

Such a solid mass (and resulting structure) comprising the anhydrous boron compound 48 will preferably have a compressive strength of about 165 MPa, a Young's modulus of about 6.09E+04 MPa, a Poisson's ratio of about 0.264, and a melting point of about 742 degrees Celsius. This compares favorably with common aluminum alloys, but the anhydrous boron compound 48 additionally has the desirable property of being dissolvable in an aqueous fluid.

For example, a structure formed of a solid mass of an anhydrous boron compound can be dissolved in water in a matter of hours (e.g., 8-10 hours). Note that a structure formed of a solid mass can have voids therein and still be "solid" (i.e., rigid and retaining a consistent shape and volume, as opposed to a flowable material, such as a liquid, gas, granular or particulate material).

If it is desired to delay the dissolving of the structure, a barrier 50 (such as, a glaze, coating, etc.) can be provided to delay or temporarily prevent hydrating of the structure due to exposure of the structure to aqueous fluid in the well.

One suitable coating which dissolves in aqueous fluid at a slower rate than the anhydrous boron compound 48 is polylactic acid. A thickness of the coating can be selected to provide a predetermined delay time prior to exposure of the anhydrous boron compound 48 to the aqueous fluid.

Other suitable degradable barriers include hydrolytically degradable materials, such as hydrolytically degradable monomers, oligomers and polymers, and/or mixtures of these. Other suitable hydrolytically degradable materials include insoluble esters that are not polymerizable. Such esters include formates, acetates, benzoate esters, phthalate esters, and the like. Blends of any of these also may be suitable.

For instance, polymer/polymer blends or monomer/polymer blends may be suitable. Such blends may be useful to affect the intrinsic degradation rate of the hydrolytically degradable material. These suitable hydrolytically degradable materials also may be blended with suitable fillers (e.g., particulate or fibrous fillers to increase modulus), if desired.

In choosing the appropriate hydrolytically degradable material, one should consider the degradation products that will result. Also, these degradation products should not adversely affect other operations or components.

The choice of hydrolytically degradable material also can depend, at least in part, on the conditions of the well, e.g., well bore temperature. For instance, lactides may be suitable for use in lower temperature wells, including those within the range of 15 to 65 degrees Celsius, and polylactides may be suitable for use in well bore temperatures above this range.

The degradability of a polymer depends at least in part on its backbone structure. The rates at which such polymers degrade are dependent on the type of repetitive unit, composition, sequence, length, molecular geometry, molecular weight, morphology (e.g., crystallinity, size of spherulites and orientation), hydrophilicity, hydrophobicity, surface area and additives. Also, the environment to which the polymer is subjected may affect how it degrades, e.g., temperature, amount of water, oxygen, microorganisms, enzymes, pH and the like.

Some suitable hydrolytically degradable monomers include lactide, lactones, glycolides, anhydrides and lactams.

Some suitable examples of hydrolytically degradable polymers that may be used include, but are not limited to, those described in the publication of Advances in Polymer Science, Vol. 157 entitled "Degradable Aliphatic Polyesters" edited by A. C. Albertsson. Specific examples include homopolymers, random, block, graft, and star- and hyper-branched aliphatic polyesters.

Such suitable polymers may be prepared by polycondensation reactions, ring-opening polymerizations, free radical polymerizations, anionic polymerizations, carbocationic polymerizations, and coordinative ring-opening polymerization for, e.g., lactones, and any other suitable process. Specific examples of suitable polymers include polysaccharides such as dextran or cellulose; chitin; chitosan; proteins; aliphatic polyesters; poly(lactides); poly(glycolides); poly(ϵ-caprolactones); poly(hydroxybutyrates); aliphatic polycarbonates; poly(orthoesters); poly(amides); poly(urethanes); poly(hydroxy ester ethers); poly(anhydrides); aliphatic polycarbonates; poly(orthoesters); poly(amino acids); poly(ethylene oxide); and polyphosphazenes.

Of these suitable polymers, aliphatic polyesters and polyanhydrides may be preferred. Of the suitable aliphatic polyesters, poly(lactide) and poly(glycolide), or copolymers of lactide and glycolide, may be preferred.

The lactide monomer exists generally in three different forms: two stereoisomers L- and D-lactide and racemic D,L-lactide (meso-lactide). The chirality of lactide units provides a means to adjust, among other things, degradation rates, as well as physical and mechanical properties.

Poly(L-lactide), for instance, is a semi-crystalline polymer with a relatively slow hydrolysis rate. This could be desirable in applications where a slower degradation of the hydrolytically degradable material is desired.

Poly(D,L-lactide) may be a more amorphous polymer with a resultant faster hydrolysis rate. This may be suitable for other applications where a more rapid degradation may be appropriate.

The stereoisomers of lactic acid may be used individually or combined. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified by blending high and low molecular weight poly(lactide) or by blending poly(lactide) with other polyesters.

Plasticizers may be present in the hydrolytically degradable materials, if desired. Suitable plasticizers include, but are not limited to, derivatives of oligomeric lactic acid, polyethylene glycol; polyethylene oxide; oligomeric lactic acid; citrate esters (such as tributyl citrate oligomers, triethyl citrate, acetyltributyl citrate, acetyltriethyl citrate); glucose monoesters; partially fatty acid esters; PEG monolaurate; triacetin; poly(ϵ-caprolactone); poly(hydroxybutyrate); glycerin-1-benzoate-2,3-dilaurate; glycerin-2-benzoate-1,3-dilaurate; starch; bis(butyl diethylene glycol)adipate; ethylphthalylethyl glycolate; glycerine diacetate monocaprylate; diacetyl monoacyl glycerol; polypropylene glycol (and epoxy, derivatives thereof); poly(propylene glycol)dibenzoate, dipropylene glycol dibenzoate; glycerol; ethyl phthalyl ethyl glycolate; poly(ethylene adipate)distearate; di-iso-butyl adipate; and combinations thereof.

The physical properties of hydrolytically degradable polymers depend on several factors such as the composition of the repeat units, flexibility of the chain, presence of polar groups, molecular mass, degree of branching, crystallinity, orientation, etc. For example, short chain branches reduce the degree of crystallinity of polymers while long chain branches lower the melt viscosity and impart, among other things, elongational viscosity with tension-stiffening behavior.

The properties of the material utilized can be further tailored by blending, and copolymerizing it with another polymer, or by a change in the macromolecular architecture (e.g., hyper-branched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains.

For example, poly(phenyllactide) will degrade at about ⅕th of the rate of racemic poly(lactide) at a pH of 7.4 at 55 degrees C. One of ordinary skill in the art with the benefit of this disclosure will be able to determine the appropriate functional groups to introduce to the polymer chains to achieve the desired physical properties of the degradable polymers.

Polyanhydrides are another type of particularly suitable degradable polymer. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

An epoxy or other type of barrier 50 which does not dissolve in aqueous fluid may be used to completely prevent exposure of the anhydrous boron compound 48 to the aqueous fluid until the barrier is breached, broken or otherwise circumvented, whether this is done intentionally (for example, to set a packer when it is appropriately positioned in the well, or to open a circulation valve upon completion of a formation testing operation, etc.) or as a result of an unexpected or inadvertent circumstance (for example, to close a valve in an emergency situation and thereby prevent escape of fluid, etc.).

A length of the anhydrous boron compound 48 is selected to provide a certain period of time from exposure of the anhydrous boron compound to an aqueous fluid, after which fluid communication is permitted through the passageway 42. In order to provide a suitable delay time, the length of the anhydrous boron compound 48 may be many times its width, for example, the length may be ten or more times the width, or preferably at least three times the width. The length of the passageway 42 may be the same as, shorter than, or longer than, the length of the anhydrous boron compound 48.

Note that, although in FIG. 2 the tube 40 is depicted as being in the fluid path between the well screen 28 and the interior of the tubular member 32, in other examples the well screen could be between the tube and the interior of the tubular member, the tube could be internal to the tubular member, the tube could be external to the well screen (such as, incorporated into an outer shroud of the well screen), etc. Thus, it should be clearly understood that the FIG. 2 configuration is merely one example of a wide variety of different configurations which can embody the principles of this disclosure.

An advantage of having the passageway 42 extend through the circuitously extending tube 40 (other than providing for an extended length of the anhydrous boron compound 48) is that, after the plug 46 has dissolved and fluid communication is permitted through the tube, a certain desired flow restriction may be provided by the tube 40. It will be appreciated that such flow restriction can be beneficial where, for example, it is desired to balance production from multiple zones, prevent water or gas coning, prevent damage to a producing formation, etc.

Although in FIG. 2 the passageway 42 is depicted as extending through the tube 40, it should be understood that this is merely one example of a wide variety of different ways in which the passageway may be provided. In other examples, the passageway 42 could be machined or molded into a component of the flow control device 30, etc.

Figure 3:
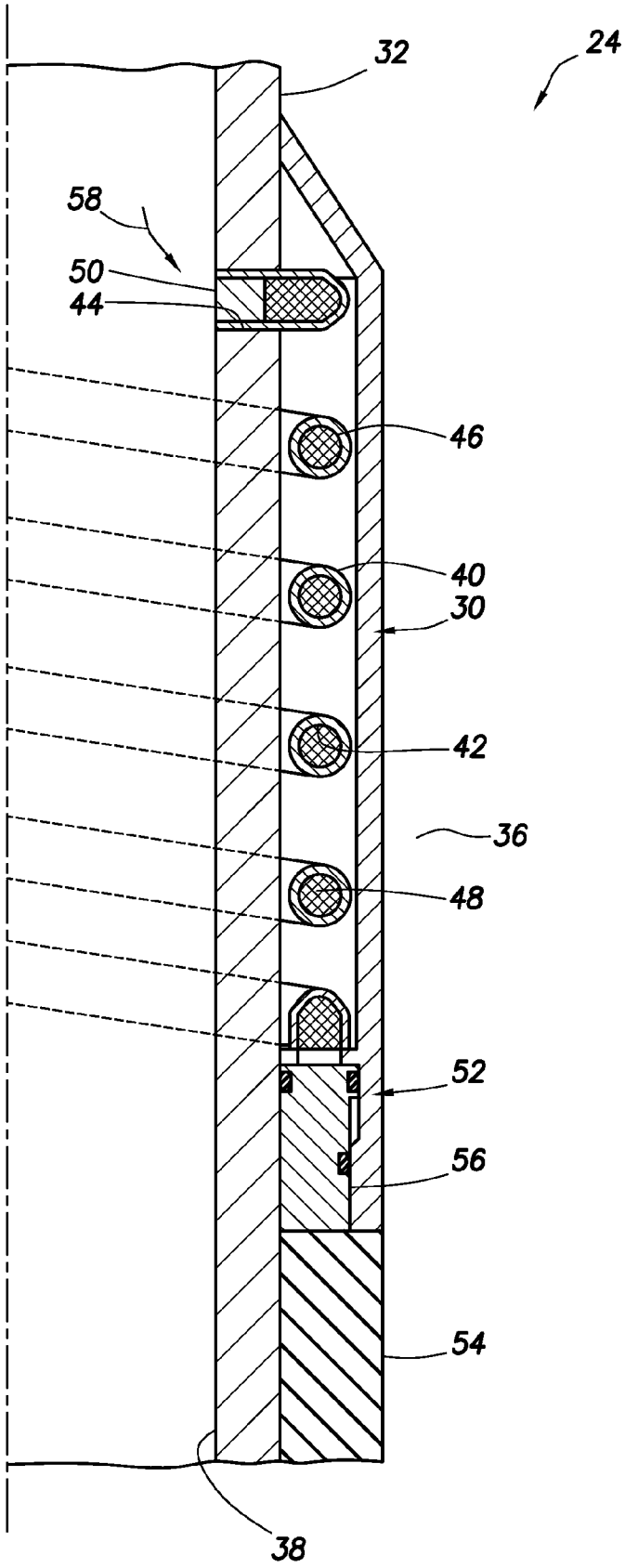
FIG. 3 is an enlarged scale schematic cross-sectional view of another well tool which may be used in the well system.

Referring additionally now to FIG. 3, a cross-sectional view of a portion of the well tool 24 is representatively illustrated. In this view, it may be seen that the well tool 24 includes the flow control device 30, an actuator 52 and an annular seal element 54.

The actuator 52 includes a piston 56 which longitudinally compresses the seal element 54 when the piston is displaced downward as viewed in FIG. 3. Longitudinal compression of the seal element 54 causes it to extend radially outward into contact with the casing 14 (for example, to seal off the annulus 36).

The flow control device 30 functions in the FIG. 3 configuration in a manner similar to that described above for the FIG. 2 configuration. After the anhydrous boron compound 48 is exposed to an aqueous fluid 58, the anhydrous boron compound begins hydrating and dissolves, eventually opening the passageway 42 to fluid communication after a predetermined period of time. The exposure of the anhydrous boron compound 48 to the aqueous fluid 58 may be delayed by providing the degradable barrier 50, although use of the degradable barrier is not essential.

When fluid communication is eventually permitted through the passageway 42, pressure in the passage 38 of the tubular member 32 can act on the piston 56, biasing it downward to compress the seal element 54. It will be appreciated that displacement of the piston 56 could be used in other examples to operate a valve, sampler, gravel packing device, perforating gun, or any other type of well tool.

It may now be fully appreciated that the above disclosure provides significant advancements to the art of operating well tools. In examples described above, operation of the well tools 22, 24 is delayed for a predetermined period of time determined by a length of an anhydrous boron compound 48 in a plug 46 which prevents fluid communication through a passageway 42.

In one aspect, the above disclosure describes a well tool 22, 24 or 26 for use with a subterranean well. The well tool 22, 24 or 26 can include an elongated passageway 42 and a plug 46 which prevents fluid communication through the passageway 42 for a predetermined period of time. The plug 46 includes an anhydrous boron compound 48, whereby the predetermined period of time is determined by a length of the anhydrous boron compound 48.

The plug 46 can comprise a solid mass of the anhydrous boron compound 48. A length of the plug 46 can be at least about three times a width of the plug 46.

The passageway 42 may extend through a sidewall of a tubular member 32.

The passageway 42 may extend through a tube 40. The tube 40 may be coiled.

The passageway 42 may extend circuitously in the well tool 22, 24 or 26.

The well tool 22, 24 or 26 can include a piston 56 which displaces in response to fluid communication being permitted through the passageway 42. The well tool 24 can also include a seal element 54 which extends radially outward in response to fluid communication being permitted through the passageway 42.

The well tool 22 can include a well screen 28 on a tubular member 32. Fluid 34 may be permitted to flow through the well screen 28 and into the tubular member 32 in response to fluid communication being permitted through the passageway 42. The passageway 42 may restrict flow of fluid 34 into the tubular member 32 when fluid communication is permitted through the passageway 42.

The well tool 22, 24 or 26 can also include a degradable barrier 50 which temporarily isolates at least one end of the anhydrous boron compound 48 from contact with an aqueous fluid 58.

The passageway 42 may be in communication with an actuator 52 of the well tool 24 or 26. Actuation of the well tool 24 or 26 can be delayed until the predetermined period of time after hydration of the anhydrous boron compound 48 begins.

The passageway 42 may be included in a flow control device 30 of the well tool 22, 24 or 26, whereby fluid flow through the flow control device 30 is delayed until the predetermined period of time after initiation of hydration of the anhydrous boron compound 48.

Also described by the above disclosure is a method of operating a well tool 22, 24 or 26 in conjunction with a subterranean well. The method can include exposing an anhydrous boron compound 48 to an aqueous fluid 58, with the anhydrous boron compound 48 being included in a plug 46 which prevents fluid communication through a passageway 42 of the well tool 22, 24 or 26. The well tool 22, 24 or 26 operates in response to fluid communication being permitted through the passageway 42 a predetermined period of time after the exposing step.

The well tool 22 operating can include fluid 34 flowing through a well screen 28 and into a tubular member 32 in response to fluid communication being permitted through the passageway 42. The passageway 42 may restrict flow of the fluid 34 into the tubular member 32 when fluid communication is permitted through the passageway 42.

The method can include the step of fixing the predetermined period of time by selecting a length of the anhydrous boron compound 48 in the plug 46. The plug 46 can comprise a solid mass of the anhydrous boron compound 48. A length of the plug 46 may be at least about three times a width of the plug 46.

The well tool 24 or 26 operating can include a piston 56 displacing in response to fluid communication being permitted through the passageway 42. The well tool 24 operating can include a seal element 54 extending radially outward in response to fluid communication being permitted through the passageway 42.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool for use with a subterranean well, the well tool comprising:

an elongated passageway; and a plug which prevents fluid communication through the passageway for a predetermined period of time, the plug including an anhydrous boron compound, whereby the predetermined period of time is varied by varying a length of the anhydrous boron compound.

2. The well tool of claim 1, wherein the plug comprises a solid mass of the anhydrous boron compound.

3. The well tool of claim 1, wherein a length of the plug is at least about three times a width of the plug.

4. The well tool of claim 1, wherein the passageway extends through a sidewall of a tubular member.

5. The well tool of claim 1, wherein the passageway extends through a tube.

6. The well tool of claim 5, wherein the tube is coiled.

7. The well tool of claim 1, wherein the passageway extends circuitously in the well tool.

8. The well tool of claim 1, further comprising a piston which displaces in response to fluid communication being permitted through the passageway.

9. The well tool of claim 1, further comprising a seal element which extends radially outward in response to fluid communication being permitted through the passageway.

10. The well tool of claim 1, further comprising a well screen on a tubular member, and wherein fluid is permitted to flow through the well screen and into the tubular member in response to fluid communication being permitted through the passageway.

11. The well tool of claim 10, wherein the passageway restricts flow of fluid into the tubular member when fluid communication is permitted through the passageway.

12. The well tool of claim 1, further comprising a degradable barrier which temporarily isolates at least one end of the anhydrous boron compound from contact with an aqueous fluid.

13. The well tool of claim 1, wherein the passageway is in communication with an actuator of the well tool, whereby actuation of the well tool is delayed until the predetermined period of time after hydration of the anhydrous boron compound begins.

14. The well tool of claim 1, wherein the passageway is included in a flow control device of the well tool, whereby fluid flow through the flow control device is delayed until the predetermined period of time after initiation of hydration of the anhydrous boron compound.

15. A method of operating a well tool in conjunction with a subterranean well, the method comprising:

exposing an anhydrous boron compound to an aqueous fluid, the anhydrous boron compound being included in a plug which prevents fluid communication through a passageway of the well tool; and the well tool operating in response to fluid communication being permitted through the passageway a predetermined period of time after the exposing step, wherein the predetermined period of time is regulated by selecting a length of the anhydrous boron compound in the plug.

16. The method of claim 15, wherein the well tool operating further comprises fluid flowing through a well screen and into a tubular member in response to fluid communication being permitted through the passageway.

17. The method of claim 16, wherein the passageway restricts flow of fluid into the tubular member when fluid communication is permitted through the passageway.

18. The method of claim 15, wherein the plug comprises a solid mass of the anhydrous boron compound.

19. The method of claim 15, wherein a length of the plug is at least about three times a width of the plug.

20. The method of claim 15, wherein the passageway extends through a sidewall of a tubular member.

21. The method of claim 15, wherein the passageway extends through a tube.

22. The method of claim 21, wherein the tube is coiled.

23. The method of claim 15, wherein the passageway extends circuitously in the well tool.

24. The method of claim 15, wherein the well tool operating further comprises a piston displacing in response to fluid communication being permitted through the passageway.

25. The method of claim 15, wherein the well tool operating further comprises a seal element extending radially outward in response to fluid communication being permitted through the passageway.

26. The method of claim 15, wherein a degradable barrier temporarily isolates at least one end of the anhydrous boron compound from contact with the aqueous fluid.

27. The method of claim 15, wherein the passageway is in communication with an actuator of the well tool, and wherein actuation of the well tool is delayed until the predetermined period of time after exposing the anhydrous boron compound to the aqueous fluid.

28. The method of claim 15, wherein the passageway is included in a flow control device of the well tool, and wherein fluid flow through the flow control device is delayed until the predetermined period of time after exposing the anhydrous boron compound to the aqueous fluid.

* * * * *